US007487839B2

(12) United States Patent
Boscher et al.

(10) Patent No.: US 7,487,839 B2
(45) Date of Patent: Feb. 10, 2009

(54) SYSTEM FOR CONTROLLING THE VERTICAL MOVEMENT OF PIPE THROUGH A STRIPPING RAM IN CONJUNCTION WITH SERVICE OR DRILLING RIGS

(75) Inventors: Vernon Robert Boscher, Drayton Valley (CA); Nigel Brian Woollam, Drayton Valley (CA)

(73) Assignee: Throttle Control Tech Inc., Drayton Valley, Alberta (CA)

( * ) Notice: Subject to any disclaimer, the term of this patent is extended or adjusted under 35 U.S.C. 154(b) by 208 days.

(21) Appl. No.: 11/143,159

(22) Filed: Jun. 2, 2005

(65) Prior Publication Data

US 2006/0201684 A1 Sep. 14, 2006

(30) Foreign Application Priority Data

Mar. 10, 2005 (CA) ..... 2500253

(51) Int. Cl.
*E21B 19/00* (2006.01)

(52) U.S. Cl. ..... 166/379; 166/85.1

(58) Field of Classification Search ..... 166/379, 166/53, 85, 255.1, 66, 66.5, 384, 385, 85.1, 166/77.1; 175/24, 85
See application file for complete search history.

(56) References Cited

U.S. PATENT DOCUMENTS 2,705,614 A * 4/1955 McKibben et al. ..... 81/57.16
3,096,075 A * 7/1963 Brown ..... 254/29 R
3,215,203 A * 11/1965 Sizer ..... 166/77.4
3,216,731 A * 11/1965 Dollison ..... 166/387
3,626,919 A 12/1971 MacMillan
3,708,020 A * 1/1973 Adamson ..... 173/7
4,085,796 A * 4/1978 Council ..... 166/77.53
4,119,297 A * 10/1978 Gunther ..... 254/29 R
4,384,612 A * 5/1983 Bradford et al. ..... 166/66
4,676,312 A * 6/1987 Mosing et al. ..... 166/77.53
4,964,462 A * 10/1990 Smith ..... 166/255.1
5,085,280 A * 2/1992 Rassieur ..... 173/176

(Continued)

FOREIGN PATENT DOCUMENTS

CA 2 211 835 1/1999

(Continued)

OTHER PUBLICATIONS

E. Hall's Mobile Truck Maintenance, Oxbow, Saskatchewan, Canada, (3 pages).

(Continued)

*Primary Examiner*—Kenneth Thompson
(74) *Attorney, Agent, or Firm*—Winstead PC

(57) ABSTRACT

A system for controlling the vertical movement of a pipe through a stripping ram. The system includes a throttle for controlling vertical movement of the pipe, a ram controller in operative communication with the ram for controlling the open or closed position of the ram, and a selector in operative communication with the ram controller and the throttle. The selector is responsive to the open or closed position of the ram. The system further includes a switch in operative communication with the selector for selectively enabling or disabling the throttle. When enabled, the throttle controls vertical movement of the pipe and when disabled, the throttle is incapable of controlling the vertical movement of the pipe.

17 Claims, 3 Drawing Sheets

U.S. PATENT DOCUMENTS

| | | | | |
|---|---|---|---|---|
| 5,444,203 | A | 8/1995 | Gunnarsson | |
| 5,791,410 | A * | 8/1998 | Castille et al. | 166/77.1 |
| 6,439,316 | B1 * | 8/2002 | Penisson | 173/1 |
| 6,968,895 | B2 * | 11/2005 | Mosing et al. | 166/77.52 |
| 7,028,586 | B2 * | 4/2006 | Robichaux | 81/57.34 |

FOREIGN PATENT DOCUMENTS

| | | |
|---|---|---|
| CA | 2 437 241 | 8/2001 |
| CA | 2 312 069 | 11/2001 |
| CA | 2 419 650 | 2/2002 |
| JP | 5212597 | 8/1993 |
| WO | WO-2004/048844 | 6/2004 |

OTHER PUBLICATIONS

Petroleum Services Association of Canada; Minutes of the Snubbing Committee Meeting Held Feb. 8, 2005, at PSAC, (4 pages).

* cited by examiner

SYSTEM FOR CONTROLLING THE VERTICAL MOVEMENT OF PIPE THROUGH A STRIPPING RAM IN CONJUNCTION WITH SERVICE OR DRILLING RIGS

FIELD OF THE INVENTION

The present invention is related to a throttle limiting control system and method for its use in association with snubbing units for rigs for servicing/drilling for oil or natural gas.

BACKGROUND OF THE INVENTION

"Snubbing" relates to the insertion of piping and tools into, or their extraction from, wells being serviced/drilled for oil and natural gas under pressure. It is conventional to employ one or more blow-out preventers BOPs in conjunction with such snubbers. The BOPs are closed into pressurized engagement with the piping in order to prevent leakage of gas under pressure from the well bore.

Conventionally, a snubbing unit is situated on top of the primary service/drilling rig BOPs. One or more sets of stripping rams are used to strip pipe sections out of and into the pressurized well.

Snubbing is done when pipe sections are pulled out/pushed into a well under pressure. Normally this pressure is from natural gas. Stripping rams and stripping annulars, components of a snubbing unit, are designed to have pipe slide through them. Pipe connectors (i.e. collars) cannot be slid through the stripping rams because of their size. When a collar is stripped from a higher pressure well, it must be "staged" out. To stage a collar out from a well, a combination of stripping annulars and stripping rams are used in accordance with the following sequential steps:

1. The pipe is hoisted by the service rig until the collar is below a stripping annular. The collar is at the stripping annular when the service rig weight indicator starts to increase in weight.
2. The adjacent stripping rams are closed.
3. The pressure that is trapped between the stripping rams and the stripping annular is then bled off to atmospheric pressure.
4. The stripping annular is then opened.
5. The service rig then hoists the collar above the stripping annular.
6. The stripping annular is then closed.
7. The pressure is then equalized from below the stripping rams to between the stripping annular and the stripping rams.
8. The stripping rams are then opened.
9. Then the pipe is hoisted to the next collar and the process starts again.

A difficulty currently exists in that, at the eighth step, the operator may forget to open a stripping ram. When this happens, a collar can be accidentally pulled into the closed stripping ram and dislodged, causing pipe sections to separate. This creates a number of possible dangers, including exposing workers to injuries from flammable gas or an explosion. For example, an incident occurred in November 2004 on a gas well in Alberta where there was a service rig and a snubbing unit on the well. The pipe was being hoisted out of the well and the workers forgot to open a stripping ram. The pipe sections separated and there was an explosion. That explosion killed the service derrick hand, burned two workers and damaged the service rig, snubbing unit and BOPs.

Thus it is an object of the present invention to provide a system, adapted for snubbing units with BOPs in conjunction with a service or a drilling rig that prevents the pipe from moving when the stripping rams are closed.

SUMMARY OF THE INVENTION

In accordance with the present invention, there is provided a system for controlling the vertical movement of a pipe through a stripping ram. The ram has an open position to allow an enlarged collar on the pipe to pass through the ram and a closed position which blocks the passage of the collar through the ram. The system includes:

a) a throttle for controlling the vertical movement of pipe;

b) a ram controller in operative communication with the ram for controlling the open or closed position of the ram;

c) a selector in operative communication with the ram controller and the throttle such that the selector is responsive to the open or closed position of the ram;

d) a switch in operative communication with the selector for selectively enabling or disabling the throttle such that, when enabled, the throttle may control the vertical movement of the pipe and when disabled, the throttle is incapable of controlling the vertical movement. The switch has first and second positions and is configured to operate such that:

i) when the ram is open and the switch is in the first position, the throttle is enabled;

ii) when the ram is open and the switch is in the second position, the throttle is disabled;

iii) when the ram is closed and the switch is in the first position, the throttle is disabled; and iv) when the ram is closed and the switch is in the second position, the throttle is enabled.

The invention also relates to method for controlling the vertical movement of a pipe through a stripping ram. The ram has an open position such that an enlarged collar on the pipe may pass through the ram and a closed position such that passage of the collar through the ram is blocked. The method comprises the steps of:

a) controlling the vertical movement of pipe with a throttle;

b) selectively enabling or disabling the throttle in response to the open or closed position of the ram, by means of operation of a switch in operative communication with the throttle and the ram. The switch has first and second positions and is configured to operate such that:

i) when the ram is open and the switch is in the first position, the throttle is enabled;

ii) when the ram is open and the switch is in the second position, the throttle is disabled;

iii) when the ram is closed and the switch is in the first position, the throttle is disabled; and iv) when the ram is closed and the switch is in second position, the throttle is enabled.

As will be disclosed in more detail subsequently, the system and method according to the present invention provide a reliable way of preventing unwanted movement of a pipe section by the rig engine, when snubbing is taking place. This unwanted movement could cause a pipe section collar to enter a closed stripping ram and cause the collar to dislodge and the pipe sections to separate. Accordingly, the safety of the service/drilling rig is significantly enhanced.

BRIEF DESCRIPTION OF THE DRAWINGS

These and other objects and advantages of the invention will become apparent upon reading the following detailed description and upon referring to the drawings in which.

Figure 1:
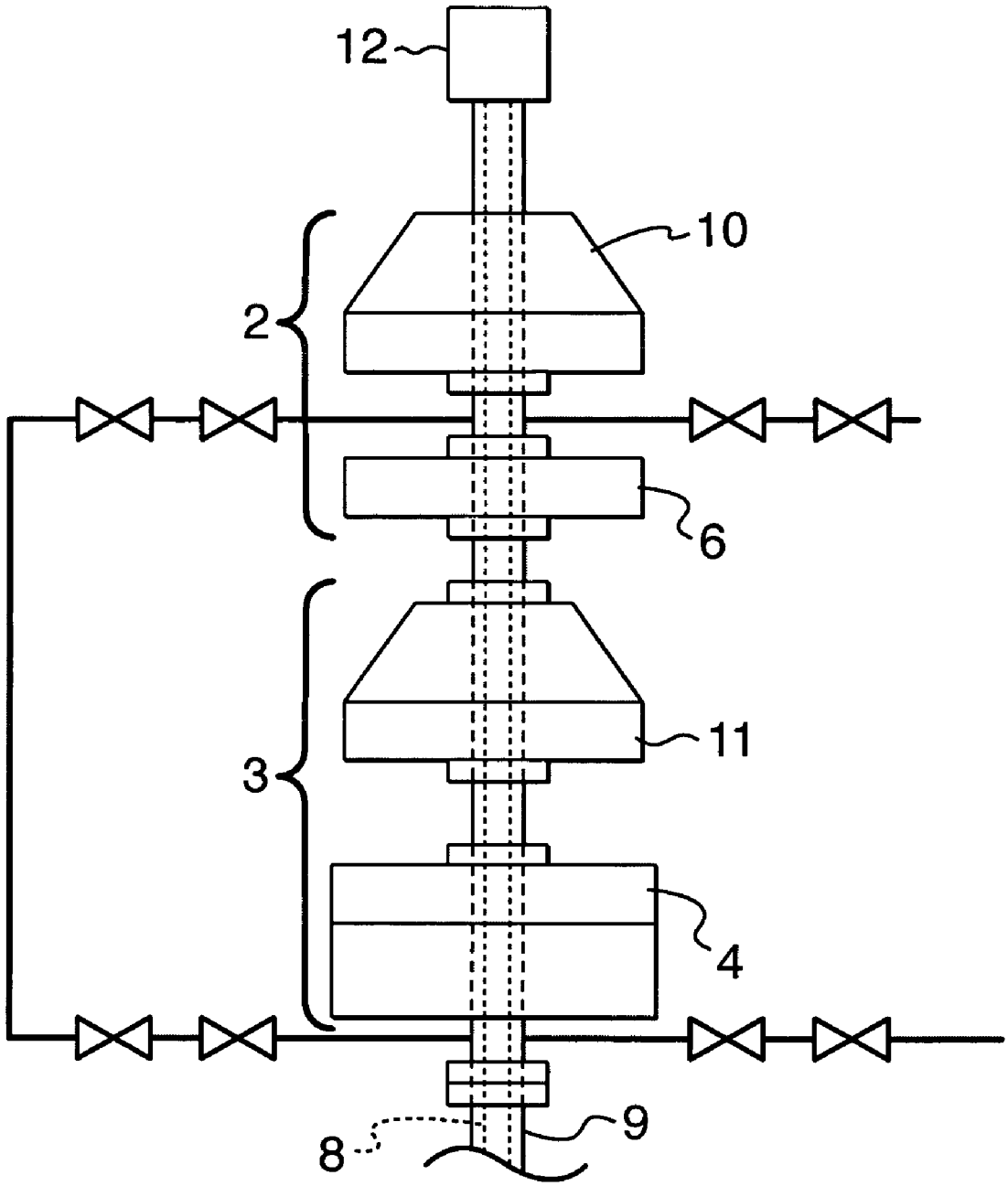
FIG. 1 is a schematic front elevation view of a stripping ram on top of a primary service/drilling rig BOPs illustrating the environment in which the present invention operates.

While the invention will be described in conjunction with the illustrated embodiment, it will be understood that it is not intended to limit the invention to such embodiment. On the contrary, it is intended to cover all alternatives, modifications and equivalents as may be included within the spirit and scope of the invention as defined by the appended claims.

DETAILED DESCRIPTION OF THE DRAWINGS

In the following description, similar features in the drawings have been given similar reference numerals.

Turning to FIG. 1, there is illustrated a snubbing BOP stripping stack 2 on top of a rig BOP stack 3, incorporating a BOP 4, for a drilling rig. The stripping stack 2 includes stripping rams 6, the purpose of which is to strip pipe 8 within casing 9 out of or force it into a pressurized well. The stripping stack 2 has associated with it a stripping annular 10, and the rig BOP stack 3 has a safety annular 11, these annulars being designed to have pipe 8 slide through them. The problem, as previously indicated, has been that the stripping pipe rams 6 will not receive collars 12 of pipe 8 when closed and hence, when the stripping rams 6 are closed, pipe 8 should not be moved so that collars 12 are forced through stripping rams 6.

Figure 2:
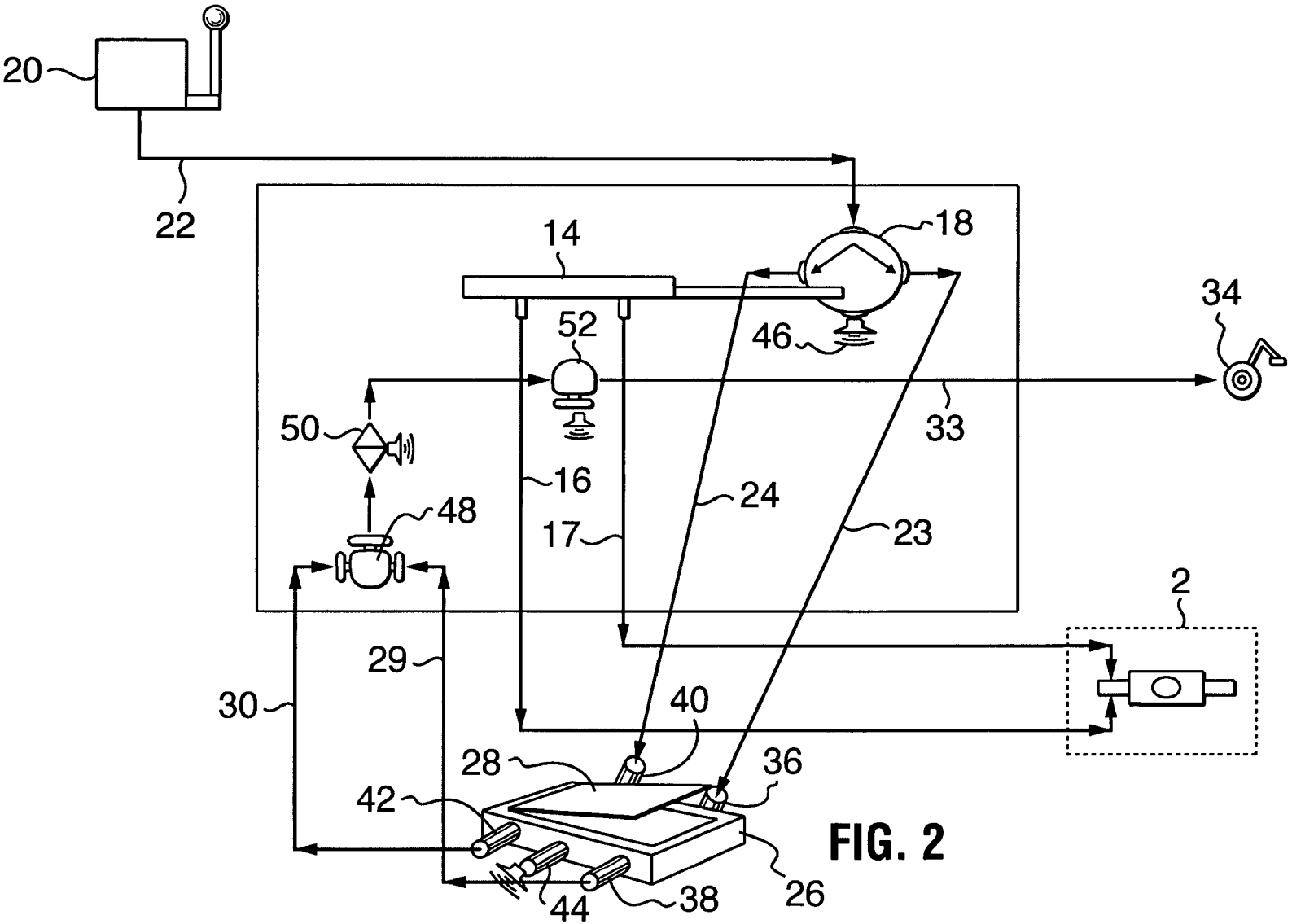
FIG. 2 is a schematic drawing of a throttle-limiting control system in accordance with the present invention, associated with a stripping ram and rig engine throttle.

Stripping rams 6, as can be seen in FIG. 2, are controlled pneumatically by stripping ram control 14 acting through hydraulic lines 16 and 17. A selector valve 18, for instance a BARKSDALE™ selector valve, responds to whether stripping ram control 14, and hence stripping rams 6, are in open or closed position.

Figure 3A:
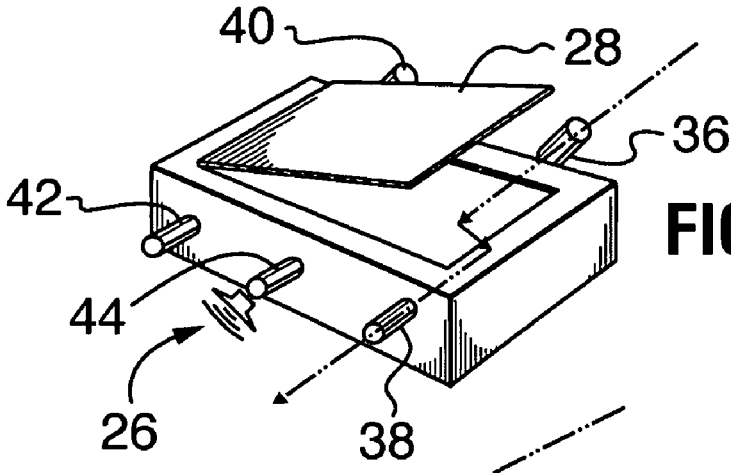
FIGS. 3*a*, 3*b*, 3*c* and 3*d* are, respectively, schematic diagrams of the main switch of the system of FIG. 2, in a first open position with the stripping rams in the open position and the service/drilling rig throttle working normally, in that same position with the stripping rams in the closed position, the system operating to prevent the engine throttle from moving the pipe, in a second, closed position with the stripping rams being still in closed position, the system operating to enable the engine to engage a pipe section to move it, and finally, in that same closed position with the stripping rams in open position, the system operating to prevent the engine throttle from moving the pipe.

Engine rig hand throttle 20 pneumatically controls rig actuator 34, through line 22 passing through selector valve 18, and lines 23 and 24 communicating through switch 26, actuated by pedal 28, and pneumatic lines 29 and 30 and 33, in a manner which will be described in more detail subsequently. Pedal 28 of switch 26 is normally biased (for example by a spring) towards an upright, open position. In this position, with stripping ram control 14 in an open position so that the stripping rams are open, normal air flow through switch 26 is from line 23, in through inlet port 36 and out through outlet port 38 (FIG. 3*a*). In this case there is normal airflow between rig hand throttle 20 along lines 23, 29 and 33, to rig throttle actuator 34.

Figure 3B:
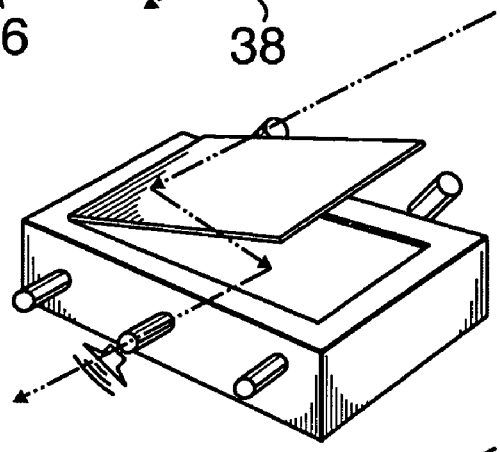

When stripping ram control 14 is closed, and stripping rams 6 are in closed position, the stripping ram control 14 is constructed so as to cause selector valve 18 to close off air travel along lines 22, 23, 29 and 33, and instead cause airflow along lines 22, 24, 30 and 33, between rig hand throttle 20 and throttle actuator 34 (FIG. 3*b*). Now, so long as pedal 28 of switch 26 is in its open position, with the pedal 28 elevated, switch 26 is configured so as to prevent passage of air from inlet port 40 to outlet port 42. Instead, air from line 24 is allowed to be dumped through exhaust port 44.

Figure 3C:
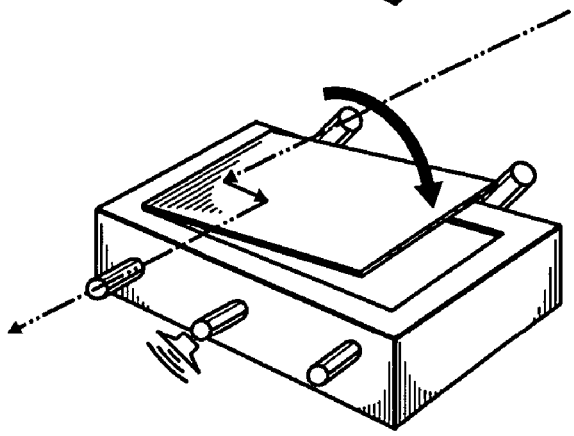
Figure 3D:
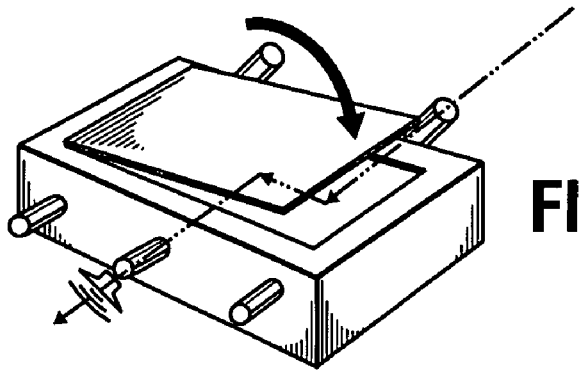

The configuration of switch 26 is such that when the pedal 28 is depressed, while stripping rams 6 are in closed position (FIG. 3*c*), air flow is permitted through switch 26 from inlet port 40 to outlet port 42, so that there is now control of actuator 34 by rig hand throttle 20 through lines 22, 24, 30 and 33. In this case, with switch 26 closed and stripping rams 6 and stripping ram control 14 closed, hand throttle 20 fully controls the action of throttle actuator 34, thereby allowing pipe 8 to be moved.

Once pedal 28 is allowed to return to its raised, open position, so long as stripping ram control 14 is closed, switch 26 is configured so that rig throttle air continues to be dumped through exhaust port 44 of switch 26 (FIG. 3*b*). As well, that air is dumped through exhaust port 46 of selector valve 18. Thus, rig throttle 20 remains inoperative.

It should be noted that a shuttle valve 48 receives the air from pneumatic lines 29 and 30 and controls the flow of that air to actuator 34. So that shuttle valve 48 does not get locked, a vent liner/perforated nipple 50 is provided in line 33 downstream from shuttle valve 48, as illustrated, to provide a constant bleed, and hence a pressure drop, downstream from shuttle valve 48 to ensure preparation of that shuttle valve and prevent it from becoming locked. A quick release valve 52 also is provided in line 33, downstream from vent liner 50, to provide an air dump to ensure that actuator 34 is deactivated as required when stripping ram control 14 is closed and stripping rams 6 are in closed position, with pedal 28 of switch 26 still being in its open position (FIG. 3*b*).

If stripping ram control 14 is open, while pedal 28 is still depressed from when the stripping rams were closed, air is now fed through line 23 to inlet port 36 of switch 26, and switch 26 is configured to have air dumped through exhaust port 44. Only when the foot pedal 28 is released will normal air flow, and hence throttle control, resume, air flowing through switch 26 between inlet port 36 to outlet port 38 again allowing pipe 8 to be moved.

Thus, it can be seen that the only way to have rig hand throttle 20 actuate actuator 34, so that pipe 8 can be moved, is if the stripping ram control 14 is open and pedal 28 is in raised or open position, or when stripping ram control 14 is closed, by depressing pedal 28. Thus, no pipe 8 can be moved at all when the stripping rams 6 are in the closed position, unless the operator physically actuates pedal 28 of switch 26 and, after that, when the rams 6 are in open position, unless the operator physically permits pedal 28 to return to its open position.

Thus, there has been provided in accordance with the invention throttle limiting control box for snubbing units in conjunction with service or drilling rigs that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

The invention claimed is:

1. A system for controlling vertical movement of a pipe through a stripping ram, said ram having an open position wherein an enlarged collar on said pipe may pass through said ram and a closed position wherein passage of said collar through said ram is blocked, said system comprising:

a throttle for controlling an actuator, said actuator configured for initiating said vertical movement of said pipe;

a selector valve in pneumatic communication with said throttle via a first pneumatic line, said selector valve responsive to said open and closed positions of said ram;

a ram controller in pneumatic communication with said ram for switching between said open and closed position of said ram, said ram controller controlling said selector valve;

a switch having first and second positions, first and second pneumatic inlets and first, second, and third pneumatic outlets, said switch connected:

from said first inlet to said selector valve via a second pneumatic line;

from said second inlet to said selector valve via a third pneumatic line;

from said first outlet to said actuator via a fourth pneumatic line;

from said second outlet to an exterior of said system; and from said third outlet to said actuator via a fifth pneumatic line;

wherein when said ram is open and said switch is in said first position, air flows from said throttle via said first and second pneumatic lines into said first inlet of said switch and thereafter from said first outlet to said actuator, thereby enabling said vertical movement of said pipe;

wherein when said ram is closed and said switch is in said first position, air flows from said throttle via said first and third pneumatic lines into said second inlet of said switch and thereafter from said second outlet to said exterior, thereby preventing actuation of said actuator and preventing vertical movement of said pipe; and wherein when said ram is closed and said switch is in said second position, air flows from said throttle via said first and third pneumatic lines into said second inlet of said switch and thereafter from said second outlet to said actuator, thereby enabling said vertical movement of said pipe.

2. The system of claim 1, wherein said switch is manually actuatable between said first and second positions.

3. The system of claim 2, wherein said switch is biased towards said first position wherein urging by an operator is required to move said switch into said second position and to retain said switch in said second position.

4. The system of claim 3, wherein said switch is operated by a foot pedal, said first position comprising an elevated position and said second position comprising a depressed position.

5. The system of claim 1, wherein said fifth pneumatic line and a sixth pneumatic lines are combined into a single pneumatic line upstream from said actuator.

6. The system of claim 5, further comprising means for providing a pressure drop disposed in said single pneumatic line.

7. The system of claim 6, wherein said means for providing the pressure drop is a vent liner or a perforated nipple valve.

8. The system of claim 6, further comprising means for providing an air dump to ensure that said actuator is deactivated when said rams are closed and said switch is in said first position.

9. The system of claim 8, wherein said means for providing the air dump is a quick release valve.

10. A method for controlling vertical movement of a pipe through a stripping ram, said ram having an open position, wherein an enlarged collar on said pipe may pass through said ram and a closed position wherein passage of said collar through said ram is blocked, said method comprising the steps of:

controlling said vertical movement of said pipe with a throttle, said throttle being in pneumatic communication with an actuator for initiating said vertical movement;

selectively enabling or disabling said actuator in response to said open or closed positions of said ram according to positioning of a selector valve, by means of operation of a switch in pneumatic communication with said throttle and said ram, said switch having first and second positions, first and second pneumatic inlets and first, second, and third pneumatic outlets, said switch connected:

from said first inlet to said selector valve via a second pneumatic line;

from said second inlet to said selector valve via a third pneumatic line;

from said first outlet to said actuator via a fourth pneumatic line;

from said second outlet to an exterior of said system; and from said third outlet to said actuator via a fifth pneumatic line;

wherein when said ram is open and said switch is in said first position, air flows from said throttle via said first and second pneumatic lines into said first inlet of said switch and thereafter from said first outlet to said actuator, thereby enabling said vertical movement of said pipe;

wherein when said ram is closed and said switch is in said first position, air flows from said throttle via said first and third pneumatic lines into said second inlet of said switch and thereafter from said second outlet to said exterior, thereby preventing actuation of said actuator and preventing vertical movement of said pipe; and wherein when said ram is closed and said switch is in said second position, air flows from said throttle via said first and third pneumatic lines into said second inlet of said switch and thereafter from said second outlet to said actuator, thereby enabling said vertical movement of said pipe.

11. The method according to claim 10, wherein said switch is manually actuated between said first and second positions.

12. The method according to claim 10, wherein said switch comprises a foot pedal biased towards said first position wherein urging by an operator is required to move said switch into said second position and to retain said switch in said second position, said first position comprising an elevated position and said second position comprising a depressed position.

13. The method according to claim 10, wherein said fifth pneumatic line and a sixth pneumatic line are combined into a single pneumatic line upstream from said actuator.

14. The method of claim 13, wherein said single pneumatic line comprises means for providing a pressure drop disposed in said single pneumatic line.

15. The method of claim 14, wherein said means for providing the pressure drop is a vent liner or a perforated nipple valve.

16. The method of claim 14, wherein said single pneumatic line comprises means for providing an air dump to ensure that said actuator is deactivated when said rams are closed and said switch is in said first position.

17. The method of claim 16, wherein said means for providing the air dump is a quick release valve.

* * * * *